US006092454A

United States Patent [19]

Vande Kerckhove

[11] Patent Number: 6,092,454

[45] Date of Patent: Jul. 25, 2000

[54] CONTROLLED FLOAT CIRCUIT FOR AN ACTUATOR

[75] Inventor: Philippe G. Vande Kerckhove, Tervuren, Belgium

[73] Assignee: Caterpillar Inc., Peoria, Ill.

[21] Appl. No.: 09/323,534

[22] Filed: Jun. 1, 1999

Related U.S. Application Data

[60] Provisional application No. 60/093,895, Jul. 23, 1998.

[51] Int. Cl.[7] ..... F15B 13/043

[52] U.S. Cl. ..... 091/464; 91/447; 91/459

[58] Field of Search ..... 91/447, 459, 464

[56] References Cited

U.S. PATENT DOCUMENTS 4,290,447 9/1981 Knutson ..... 91/464 X

*Primary Examiner*—Gerald A. Michalsky
*Attorney, Agent, or Firm*—J. W. Burrows

[57] ABSTRACT

A controlled float circuit is provided for controlling a load free of requiring flow from the source of pressurized fluid even when the float mode is activated with the load above the ground. The subject invention includes having a load lowering check valve arrangement disposed adjacent an actuator having first and second inlet ports with a pilot operated check valve disposed between the second inlet port and a location downstream of the load lowering valve. A first normally open electrically controlled valve is disposed in the pilot conduit leading to one end of a directional control valve and a second normally closed electrically controlled valve disposed between a source of pressurized pilot fluid and the pilot stage of the pilot operated check valve. Engagement of the float mode of operation blocks pilot flow to one end of the directional valve and opens the pilot operated check valve. A down command signal is blocked from the directional control valve but directed to the load lowering valve to controllably pass fluid from one end of the actuator to the other while not requiring any flow from the source of pressurized fluid.

15 Claims, 2 Drawing Sheets

CONTROLLED FLOAT CIRCUIT FOR AN ACTUATOR

This application claims the benefit of prior provisional patent application Ser. No. 60/093,895 filed Jul. 23, 1998.

TECHNICAL FIELD

The subject invention relates generally to a float circuit for an actuator and more particularly to a float circuit for an actuator that is selectively controlled.

BACKGROUND ART

There are various known float arrangements. The basic principle of float is to allow both ends of an actuator to intercommunicate so that the implement attached to the actuator is free to move relative to the surface or contour that it is following. More specifically, a loader bucket is permitted to follow the contour of the ground when attempting to load loose material from a hard, uneven or rolling surface or even from the floor of a ship being unloaded. In most float arrangements, it is necessary to lower the implement to the ground or hard surface then place the actuator in the float position. When lowering the implement, it is necessary to direct pressurized fluid into one end of the actuator while exhausting the fluid from the other end. Even though the pressure/horsepower requirements for lowering the implement is relatively small, the flow being used from the pump is effectively being wasted. In most fluid circuit, the quantity of available fluid flow at any given time is always an important issue. In order to alleviate the loss of fluid being used to lower the implement to the ground, some systems have used float arrangements that may be engaged with the implement above the ground or surface. In these systems, the implement may come down to quickly and even bounce when it hits the ground. It is more desirable to provide a float arrangement that can be used to controllably lower the implement following engagement of the float control while not requiring flow from the source of pressurized fluid. Additionally, it may be desirable to provide float only to one end of the actuator so that the movement of the implement can be inhibited in one of its directions of movement.

The present invention is directed to overcoming one or more of the problems as set forth above.

DISCLOSURE OF THE INVENTION

In one aspect of the subject invention, a controlled float circuit is provided and adapted for use in a fluid circuit having a source of pressurized fluid connected through a pilot operated directional control valve to an actuator having first and second inlet ports and a reservoir. The fluid circuit also includes a source of pressurized pilot fluid operatively connected through a pilot control valve arrangement to the pilot operated directional control valve. The controlled float circuit includes a load lowering valve arrangement having a pilot operated proportional valve disposed between the first inlet port and the reservoir, and a make-up valve disposed between the first inlet port of the actuator and the reservoir. The pilot operated proportional valve is spring biased to a flow blocking position and controllably movable towards a flow passing position in response to receipt of pressurized pilot fluid from the pilot control valve arrangement. The fluid circuit also includes a pilot operated check valve disposed between the second inlet port of the actuator and a location between the pilot operated proportional valve and the reservoir. The second pilot operated check valve is operative to normally block flow therethrough from the second inlet port of the actuator and movable to a flow passing position in response to receipt of a pressure signal. First and second electrically controlled valves are also disposed in the fluid circuit. The first electrically controlled valve is disposed between the pilot control valve and one end of the pilot operated directional control valve. The first electrically controlled valve is spring biased to a first position at which pressurized fluid flow from the pilot control valve is free to flow to the one end of the pilot operated directional control valve and movable to a second position at which fluid flow therethrough is blocked. The second electrically controlled valve is disposed between the source of pressurized pilot fluid and the pilot operated check valve. The second electrically controlled valve is spring biased to a first position at which the source of pressurized pilot fluid is blocked from the pilot operated check valve and movable to a second position at which the source of pressurized fluid is passed therethrough.

BEST MODE FOR CARRYING OUT THE INVENTION

Figure 1:
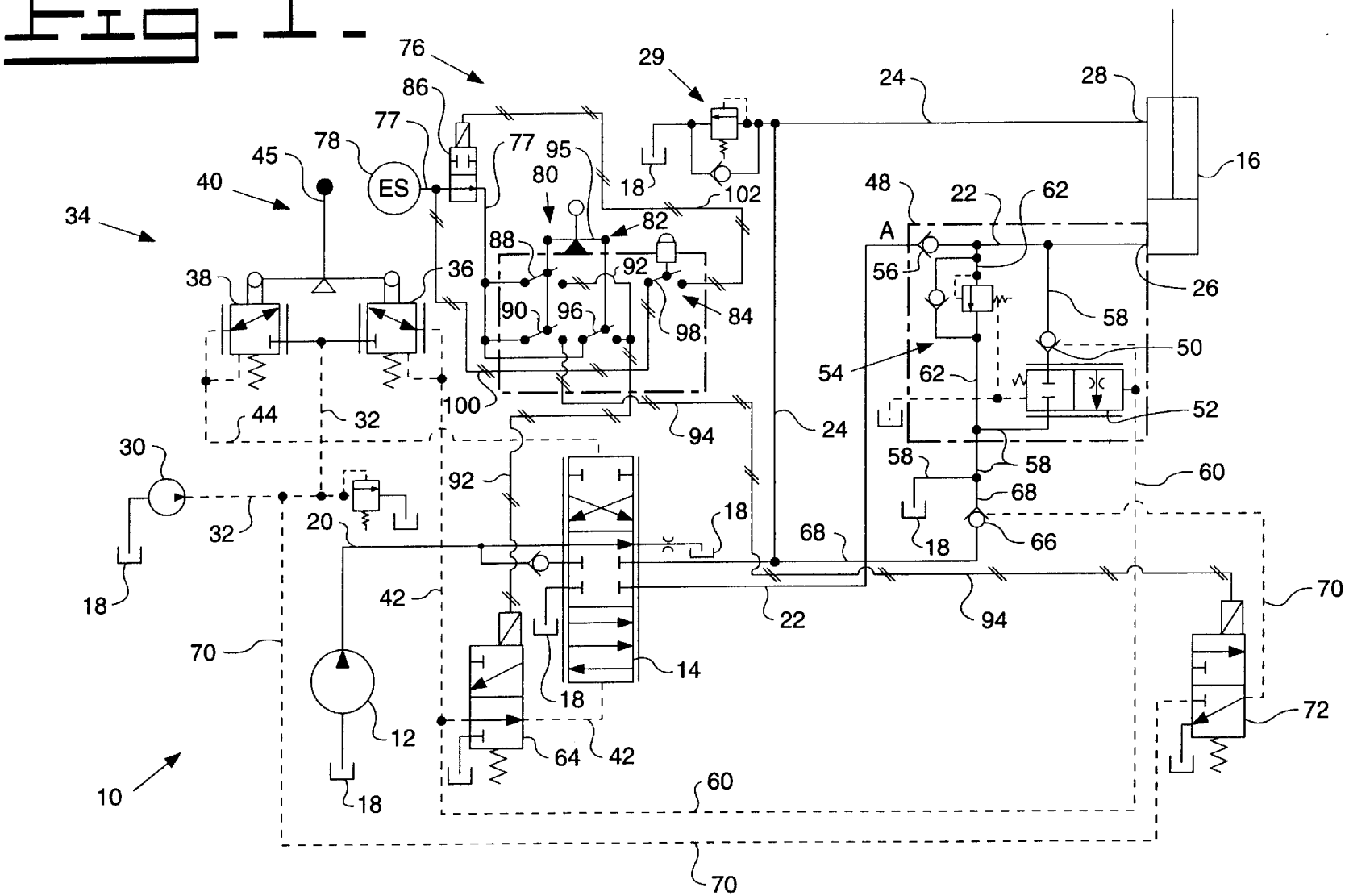
FIG. 1 is a schematic representation of a fluid system incorporating an embodiment of the subject invention.

Referring to the FIG. 1 of the drawings, a fluid circuit 10 is illustrated and includes a source of pressurized fluid 12 connected through a pilot operated directional control valve 14 to an actuator 16. A reservoir 18, in a well known manner, receives exhaust fluid from the directional control valve 14 and provides fluid to the source of pressurized fluid 12. A supply conduit 20 connects the pump 12 with the directional control valve 14 and first and second feed conduits 22,24 connect the directional control valve 14 to respective first and second inlet ports 26,28 of the actuator 16. A relief and make-up valve arrangement 29 is connected between the second feed conduit 24 and the reservoir 18 and operates in a well known manner.

A source of pressurized pilot fluid 30 is connected through a pilot supply conduit 32 to a pilot control valve arrangement 34. It is recognized that the source of pressurized pilot fluid 30 could be provided through a pressure reducing valve from the source of pressurized fluid 12 without departing from the essence of the subject invention. The pilot control valve arrangement 34 has first and second proportional pressure control portion 36,38 and a control input mechanism 40. The first pressure control portion 36 is connected by a first pilot control conduit 42 to one end of the directional control valve 14 and the second pressure control portion 38 is connected by a second pilot control conduit 44 to the other end of the directional control valve 14. Pressurized pilot fluid is proportionally directed in a well known manner to the respective ends of the directional control valve 14 in response to movement of a lever 45 of the control input mechanism 40.

A controlled float circuit 46 is provided to provide a float mode for the actuator 16. The controlled float circuit 46 includes a load lowering valve arrangement 48. The load lowering check valve arrangement 48 includes a first pilot operated check valve 50, a pilot operated proportional valve 52, a relief and make-up valve 54 and a one-way check valve 56. In the subject embodiment, the load lowering check valve arrangement 48 is connected directed to the actuator 16 and the first feed conduit 22 is directed therethrough to the first inlet port 26. The one-way check valve 56 is disposed in the first feed conduit 22. It is recognized that the first feed conduit 22 and the one-way check valve 56 could be located external of the load lowering check valve arrangement 48 without departing from the essence of the subject invention.

An exhaust conduit 58 is connected at one end to the first feed conduit 22 at a location between the one-way check valve 56 and the first inlet port 26 of the actuator 16 and at the other end to the reservoir 18. The first pilot operated check valve 50 is disposed in the exhaust conduit 58 and operative to inhibit fluid flow therethrough from the first inlet port 26. The first pilot operated check valve 50 is movable towards its free flow position in response to receipt of pressurized fluid through a signal conduit 60 and the first pilot control conduit 42 from the first pressure control portion 36 of the pilot control valve arrangement 34.

The pilot operated proportional valve 52 is disposed in the exhaust conduit 58 between the first pilot operated check valve 50 and the reservoir 18. The pilot operated proportional valve 52 is spring biased to a first position at which fluid flow therethrough is blocked and movable towards a free flow position in response to receipt of a pressure signal through the signal conduits 42,60 from the first pressure control portion 36 of the pilot control valve arrangement 34.

The relief and make-up valve 54 is connected by a conduit 62 between the reservoir 18 and the first feed conduit 22 at a location between the one-way check valve 56 and the first inlet port 26 of the actuator 16. The relief and make-up valve 56 operates in a well known manner to relieve high pressure spikes in the first feed conduit 22 at the first inlet port 26 and to provide fluid flow from the reservoir 18 to offset cavitation at the first inlet port 26.

A first electrically controlled valve 64 is disposed in the conduit 42 and operative to selectively block the flow of pressurized fluid to the one end of the directional control valve 14. The first electrically controlled valve 64 is spring biased to a first position at which flow freely passes therethrough and movable to a second position at which fluid flow therethrough is blocked. The first electrically controlled valve 64 is movable to its second position in response to receipt of an electrical signal.

A second pilot operated check valve 66 is disposed in a conduit 68 between a location downstream of the pilot operated proportional valve 52 and the second inlet port 28 of the actuator 16. In the subject embodiment, the conduit 68 is connected between the exhaust conduit 58 and the second feed conduit 24. The second pilot operated check valve 66 normally inhibits flow therethrough from the second inlet port 28 towards the exhaust conduit 58 and is selectively operable to permit free flow therethrough. A pilot conduit 70 connects the source of pressurized pilot fluid 30 to the pilot stage of the second pilot operated check valve 66.

A second electrically controlled valve 72 is disposed in the conduit 70 and operative to selectively block the flow of pressurized pilot fluid from the source 30 to the second pilot operated check valve 66. The second electrically controlled valve 72 is spring biased to a first position at which the source of pressurized pilot fluid is blocked and a second position at which the pressurized fluid is directed therethrough. The second electrically controlled valve 72 is moved to its second position in response to receipt of an electrical signal.

The controlled float circuit 46 further includes a switch assembly 76 adapted to receive electrical energy through an electrical line 77 from a source of electrical energy 78. The switch assembly 76 includes first, second, and third switch arrangements 80,82,84 and an electrically controlled on/off switch 86.

The first switch arrangement 80 includes first and second switches 88,90. The first switch 88 is operative to control electrical energy through an electrical line 92 from the source of electrical energy 78 to the first electrically controlled valve 64. The second switch 90 is operative to control electrical energy through an electrical line 94 from the source of electrical energy 78 to the second electrically controlled valve 72. In the subject embodiment, the first and second switches 88,90 are actuated simultaneously by a rocker member 95.

The second switch arrangement 82 includes one switch 96 that is operative to control electrical energy through the electrical line 92 to the first electrically controlled valve 64. The one switch 96 of the second switch arrangement 82 is also actuated by the rocker member 95.

The third switch arrangement 84 includes one switch 98 that is connected directly to the source of electrical energy 78 upstream of the electrically controlled on/off relay 86 through an electrical line 100 and is operative to control electrical energy through the electrical line 102 to the electrically controlled on/off relay 86.

Figure 2:
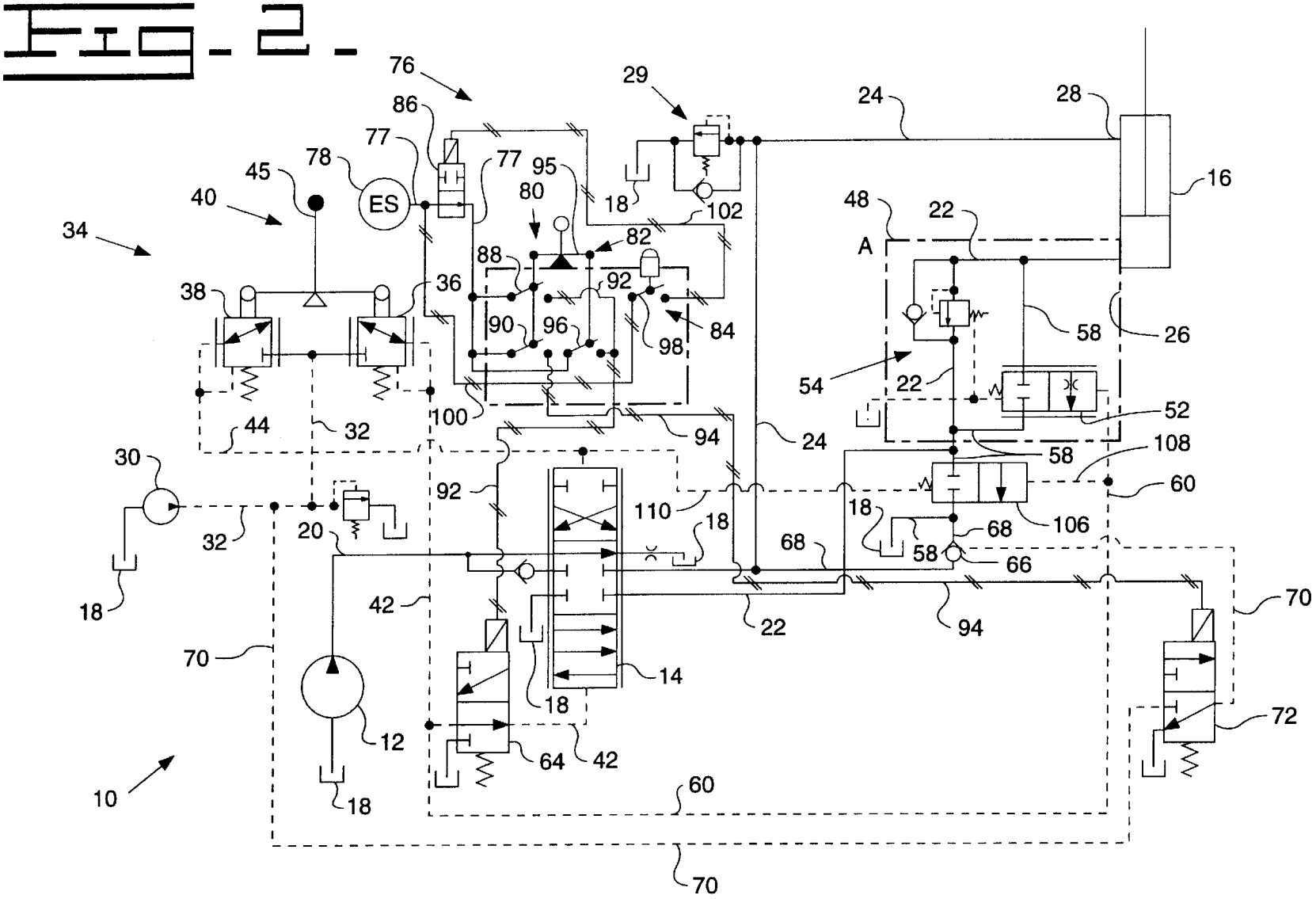
FIG. 2 is a schematic representation of a fluid system incorporating another embodiment of the subject invention

Referring to the fluid circuit 10 of FIG. 2, another embodiment of the subject invention is disclosed. Like elements have like element numbers. The following description of the embodiment of FIG. 2 is directed to the differences or additions to FIG. 2 with respect to FIG. 1.

The first feed conduit 22 is connected to the first inlet port 26 of the actuator 16 through the one-way check of the relief and make-up valve 54 and the one-way check valve of FIG. 1 has been removed. In the subject embodiment, the relief and make-up valve 54 is disposed in the first feed conduit 22. Additionally, the pilot operated check valve 50 and its pilot conduit that was disposed in the conduit 58 of FIG. 1 has been removed. The conduit 58 is connected between the first feed conduit 22 adjacent the first inlet port 26 downstream of the relief and make-up valve 54 and the reservoir 18. The conduit 58 is also connected to the first feed conduit 22 upstream of the relief and make-up valve 54 and has a normally closed exhaust valve 106 disposed therein at a location between the connection with the first feed conduit 22 upstream of the relief and make-up valve 54 and the reservoir 18. The normally closed exhaust valve 106 is spring biased to its normally closed position and biased to its open position in response to receipt of a pressure signal through a pilot conduit 108 from the first pressure control portion 36 of the pilot control valve arrangement 34. A pilot conduit 110 is connected between the second pressure control portion 38 through the pilot conduit 44 and the spring end of the normally closed exhaust valve 106. The pilot conduit 110 is operative to deliver a pressure signal to the spring end of the normally closed exhaust valve 106 to aid the force of the spring in moving the normally closed exhaust valve 106 to its closed position. It is recognized that the pilot conduit 110 is not required for the successful operation of the subject invention.

As illustrated, the pilot operated check valve 66 and conduit 68 remains connected between the conduit 58, downstream of the normally closed exhaust valve 106 and the second feed conduit 24.

INDUSTRIAL APPLICABILITY

In the operation of the subject fluid circuit 10 having the controlled float circuit 46, the operator raises the load (implement) by moving the lever 45 of the control input mechanism 40 towards the left as shown in the drawing. Movement of the lever 45 leftward activates the second pressure control portion 38 in an amount proportional to the degree of movement of the lever 45. The pressurized fluid therefrom is directed through the pilot conduit 44 to the other end of the directional control valve 14 moving it to one of its operative position. The degree of movement of the directional control valve 14 is proportional to the level of pilot pressure in the conduit 44. Pressurized fluid is directed through the first feed conduit 22, the check valve 56 and the first inlet port 26 of the actuator 16 to raise the actuator 16. The exhaust fluid from the second inlet port 28 is directed through the second feed conduit 24 across the directional control valve 14 to the reservoir 18.

To lower the load, the operator moves the lever 45 in a rightward direction to direct pressurized pilot fluid to the one end of the directional control valve 14. Since the first electrically controlled valve 64 is not actuated, the pressurized fluid is freely passed therethrough. Movement of the directional control valve 14 to its other operative position direct pressurized fluid through the second feed conduit 24 to the second inlet port 28. The exhaust flow from the first inlet port 26 is not permitted to freely flow back to the reservoir 18 through the first feed conduit 22 and the directional control valve 14. The pressurized pilot fluid that is being used to move the directional control valve 14 to its other operative position is also directed through the signal conduit 60 and used to unseat the first pilot operated check valve 50. Simultaneously, the same pressurized fluid is used to move the pilot operated proportional valve 52 towards its flow passing position to direct the exhaust flow through the exhaust conduit 58 to the reservoir 18.

The degree of movement of the pilot operated proportional valve 52 is directly proportional to the pressure level in the conduit 60. Consequently, the rate of lowering the load is directly controlled by the operator through movement of the lever 45. Since the conduits 24,68 are pressurized, the second pilot operated check valve 66 does not open.

In the event the load is elevated above the ground and the operator desires to activate the float circuit, the operator still has control of the load while it is being lowered. At the same time the flow from the source of pressurized fluid 12 can be used in other parallel circuits (not shown). In order to actuate the float circuit, the operator engages the first switch arrangement 80. Simultaneously, electrical signals are directed to both of the first and second electrically controlled valves 64,72 moving them to their respective second positions. With the second electrically controlled valve 72 in its second position, pressurized fluid from the source of pressurized pilot fluid 30 is directed to the second pilot operated check valve 66 moving it to its flow passing position thus interconnecting the conduit 68, the reservoir 18 and the second inlet port 28 through the second feed conduit 24. Since the first pilot operated check valve 50 and the proportional valve 52 remain in their respective first positions, the load still will not come down.

With the first electrically controlled valve 64 in its second position, the one end of the directional control valve 14 is vented to the reservoir 18 and the one end of the directional control valve 14 is blocked from the first pressure control portion 36 of the pilot control valve arrangement 34. With the directional control valve 14 in its centered flow blocking position, the pressurized fluid from the source of pressurized fluid 12 is available to other parts of the system.

To lower the load, the operator moves the lever 45 rightward to pressurize the signal conduits 42,60. The pressurized fluid in the signal conduit 42 is blocked from the one end of the directional control valve 14 but the pressurized fluid in the signal conduit 60 is simultaneously directed to the first pilot operated check valve 50 and the pilot operated proportional valve 52. The pressurized fluid opens the first pilot operated check valve 50 and moves the proportional valve 52 towards its full open position in proportion to the level of pressure in the conduit 60 from the first pressure control portion 36. The fluid passing through the proportional valve 52 is free to flow through the conduit 68 across the open second pilot operated check valve 66 and on to the second inlet port 28 to fill the void being created at the second inlet port 28 due to movement of the load downwardly. If the volume of flow being exhausted from the first inlet port 26 is greater than that needed at the second inlet port 28, the extra volume of fluid is free to pass to the reservoir 18 through the conduit 58.

Once the load reaches the ground in a controlled manner, the actuator 16 is still free to move up and down to allow the implement to follow the contour of the ground or to follow a moving surface, i.e., unloading of a ship. During this float mode of operation subsequent to the load being fully lowered, the level 45 is maintained in its rightward position to permit full float of the actuator 16.

If the operator moves the lever 45 to its neutral position, the load is still permitted to freely float or move in the upward direction. The fluid needed at the first inlet port 26 during float in an upward direction only is provided by the exhaust from the second inlet port 28 and fluid from the reservoir 18. The fluid from the second inlet port 28 is directed through the conduits 24,68 across the second pilot operated check valve 66 and combined with any needed additional fluid drawn from the reservoir 18. The combined fluid is then directed through the conduits 58,62, across the check (make-up) valve in the relief and make-up valve 54 and through the conduit 22 to the first inlet port 26.

At any time during the float mode of operation, the operator can interrupt the float mode by engaging the switch 98 of the third switch arrangement 84. Engagement of the switch 98 activates the electrically controlled on/off relay 86 which blocks the source of electrical energy 78 from the switch assembly 76. When the electrical energy from the source 78 is interrupted, both of the first and second electrically controlled valves 64,72 return to their respective first positions. With both of the first and second electrically controlled valves 64,72 in their first positions, the system operates in a normal non-float mode.

If it is desirable to permit the actuator 16 to float in only a downward direction, the operator engages switch 96 of the second switch arrangement 82. When operating an attachment such as a rock hammer or the like, it is desirable to block upward movement of the actuator 16 but permit free or floating movement in the downward direction. With the switch 96 engaged, only the first electrically controlled valve 64 is engaged. Since the second electrically controlled valve 72 remains in its first position, the second pilot operated check valve 66 remains closed.

With the lever 45 moved towards its rightward position, the first pilot operated check valve 50 is open and the proportional valve 52 is open to an extent proportional to the position of the lever 45. Consequently, the actuator 16 is free to float downward whenever the downward resistance is removed, such as by the object being broken from the impact blows of the hammer or the like. The degree of freedom to move downward is controlled by the placement of the lever 45. As previously noted, if it is desired to interrupt the float mode, the operator merely engages the switch 98 of the third switch arrangement 84.

In the operation of the embodiment of FIG. 2, in order to raise the load the pressurized fluid in the first feed conduit 22 from the directional valve 14 is directed to the first inlet port 26 through the check valve of the relief and make-up valve 54. The exhaust flow from the second inlet port 28 is returned to the reservoir 18 through the second feed conduit 24 and across the directional valve 14.

When lowering the load during normal operation, a pilot signal is directed from the first pressure control portion 36 through the normally open first electrically controlled valve 64 to the one end of the directional control valve 14. The pressurized fluid from the directional control valve 14 is directed through the second feed conduit 24 to the second inlet port 28. The exhaust fluid from the first inlet port 26 is block by pilot operated proportional valve 52 and the relief and make-up valve 54. However, simultaneously the pressurized pilot fluid in the pilot control conduit 42 is being directed through the pilot conduit 60 to the proportional valve 52 urging it towards its second position to exhaust the fluid from the first inlet port 26 to the reservoir 18 through the conduit 22 and across the directional control valve 14. The proportional valve 52 is moved in proportion to the pressure signal in the pilot control conduit 42.

The switch assembly 76 operates in the same manner as that with respect to FIG. 1. As previously set forth with respect to FIG. 1, actuation of the first switch arrangement 80 results in each of the first and second electrically controlled valves 64,72 being moved to their respective second positions. If the load is being held above the work surface or ground, the operator controllably moves the lever 45 towards a rightward position in order to lower the load/actuator 16. The pressurized fluid in the conduit 60 from the first pressure control portion 36 acts to proportionally move the pilot operated proportional valve 52 towards its second position and simultaneously acts to move the normally closed exhaust valve 106 to its open position. Since the pilot operated check valve 66 has been opened in response to the pressure signal in the conduit 70, any exhaust flow from the inlet port 26 is free to pass through the conduit 68 to the second inlet port 28 through the second feed conduit 24. Any excess flow from the first inlet port 26 is directed to the reservoir 18 through the conduit 58. Once the load reaches the ground and with the lever 45 in a rightward position, the load is free to float up or down. If the load in the actuator 16 floats in the other direction, fluid flow from the second inlet port 28 flows back to the first inlet port 26 through the second feed conduit 24, the open pilot operated check valve 66, the open exhaust valve 106 and across the check valve of the relief and make-up valve 54. If additional fluid is needed at the first inlet port 26 it is drawn from the reservoir 18 through the conduit 58 and added to the fluid in the conduit 68.

If only the second switch arrangement 82 is actuated, the first electrically controlled valve 64 is moved to its second position and the second electrically controlled valve 72 remains in its first position. As also set forth with respect to FIG. 1, in this mode of float operation with the lever in a rightward position, the actuator 16 is free to float down (as viewed in the drawing) but is inhibited from floating in an upward direction.

The third switch arrangement of FIG. 2 functions the same as that with respect to FIG. 1 and will not be further described.

In view of the foregoing, it is readily apparent that the present invention provides a controlled float circuit that enables an operator to control the rate of lowering a load free of requiring flow from the source of pressurized fluid even when he engages the float mode of operation while the load is still elevated above the ground. Additionally, the subject invention permits an actuator to have a float mode of operation in only one direction of movement free of requiring flow from the source of pressurized fluid.

Other aspects, objects and advantages of this invention can be obtained from a study of the drawings, the disclosure and the appended claims.

What is claimed is:

1. A controlled float circuit adapted for use in a fluid circuit having a source of pressurized fluid connected through a pilot operated directional control valve to an actuator having first and second inlet ports and a reservoir, the fluid circuit also includes a source of pressurized pilot fluid operatively connected through a pilot control valve arrangement to the pilot operated directional control valve, the controlled float circuit comprising:

a load lowering valve arrangement having a pilot operated proportional valve disposed between the first inlet port and the reservoir, and a relief and make-up valve disposed between the first inlet port of the actuator and the reservoir, the pilot operated proportional valve being spring biased to a flow blocking position and controllably movable towards a flow passing position in response to receipt of pressurized pilot fluid from the pilot control valve arrangement;

a pilot operated check valve disposed between the second inlet port of the actuator and a location between the a pilot operated proportional valve and the reservoir, the pilot operated check valve being operative to normally block flow therethrough from the second inlet port of the actuator and movable to a flow passing position in response to receipt of a pressure signal;

a first electrically controlled valve disposed between the pilot control valve and one end of the pilot operated directional control valve, the electrically controlled valve being spring biased to a first position at which pressurized fluid flow from the pilot control valve is free to flow to the one end of the pilot operated directional control valve and movable to a second position at which fluid flow therethrough is blocked; and a second electrically controlled valve disposed between the source of pressurized pilot fluid and the pilot operated check valve, the second electrically controlled valve being spring biased to a first position at which the source of pressurized pilot fluid is block from the pilot operated check valve and movable to a second position at which the source of pressurized fluid is passed therethrough.

2. The controlled float circuit of claim 1 wherein the pilot control valve arrangement has first and second pressure control portions controllably movable in response to movement of a control lever, the pressurized fluid from the first pressure control portion is directed to one end of the pilot operated directional control valve and the pressurized fluid from the second pressure control portion is directed to the other end thereof.

3. The controlled float circuit of claim 2 wherein the pressurized fluid being directed to the pilot operated proportional valve from the pilot control valve arrangement is from the first pressure control portion thereof.

4. The controlled float circuit of claim 3 wherein the pilot operated check valve is selectively movable to its flow passing position in response to pressurized fluid from the source of pressurized pilot fluid.

5. The controlled float circuit of claim 4 including a normally closed exhaust valve disposed between the pilot operated proportional valve and the reservoir, the normally closed exhaust valve being movable to an open position in response to a pressure signal from the first pressure control of the pilot control arrangement.

6. The controlled float circuit of claim 5 including a source of electrical energy and a switch assembly, the switch assembly being operative to selectively actuate the first and second electrically controlled valves.

7. The controlled float circuit of claim 6 wherein the switch assembly includes a first switch arrangement operative when actuated to direct an electrical signal to each of the first and second electrically controlled valves moving them to their respective second positions.

8. The controlled float circuit of claim 7 wherein the switch assembly includes a second switch arrangement operative when actuated to direct an electrical signal to only the first electrically controlled valves moving it to its second position.

9. The controlled float circuit of claim 8 wherein the first and second switch arrangements of the switch assembly are actuated by a single rocker lever.

10. The controlled float circuit of claim 4 wherein the load lowering valve arrangement includes a pilot operated check valve connected between the first inlet port of the fluid actuator and the pilot operated proportional valve and operative to normally block flow therethrough from the first inlet port to the pilot operated proportional valve and movable to a flow passing position in response to receipt of a pressure signal from the first pressure control portion of the pilot control valve arrangement.

11. The controlled float circuit of claim 10 including a source of electrical energy and a switch assembly, the switch assembly being operative to selectively actuate the first and second electrically controlled valves.

12. The controlled float circuit of claim 11 wherein the switch assembly includes a first switch arrangement operative when actuated to direct an electrical signal to each of the first and second electrically controlled valves moving them to their respective second positions.

13. The controlled float circuit of claim 12 wherein the switch assembly includes a second switch arrangement operative when actuated to direct an electrical signal to only the first electrically controlled valves moving it to its second position.

14. The controlled float circuit of claim 13 wherein the first and second switch arrangements of the switch assembly are actuated by a single rocker lever.

15. The controlled float circuit of claim 14 wherein the switch assembly includes an electrically controlled on/off switch disposed between the source of electrical energy and the switch assembly and a third switch arrangement, the third switch arrangement is connected to the source of electrical energy and operative when actuated to interrupt the flow of electrical energy to the switch assembly.

* * * * *